US011345172B2

(12) United States Patent
Saito et al.

(10) Patent No.: US 11,345,172 B2
(45) Date of Patent: May 31, 2022

(54) PRINTING APPARATUS AND TRAY UNIT

(71) Applicant: CANON KABUSHIKI KAISHA, Tokyo (JP)

(72) Inventors: Hiroyuki Saito, Tokyo (JP); Yasushi Ishida, Tokyo (JP); Tomohiko Yata, Tokyo (JP); Masaaki Ishihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/167,487

(22) Filed: Feb. 4, 2021

(65) Prior Publication Data

US 2021/0252883 A1 Aug. 19, 2021

(30) Foreign Application Priority Data

Feb. 14, 2020 (JP) ..... JP2020-023661

(51) Int. Cl.
*B41J 13/10* (2006.01)
*B65H 31/20* (2006.01)
*B65H 31/02* (2006.01)

(52) U.S. Cl.
CPC ..... *B41J 13/103* (2013.01); *B41J 13/106* (2013.01); *B65H 31/20* (2013.01); *B65H 31/02* (2013.01); *B65H 2402/32* (2013.01); *B65H 2405/115* (2013.01); *B65H 2405/1122* (2013.01); *B65H 2405/11164* (2013.01); *B65H 2405/321* (2013.01); *B65H 2405/324* (2013.01)

(58) Field of Classification Search
CPC ..... B41J 13/103; B41J 13/106; B65H 31/20; B65H 31/02; B65H 2402/32; B65H 2405/11164; B65H 2405/1122; B65H 2405/115; B65H 2405/321; B65H 2405/324
See application file for complete search history.

(56) References Cited

U.S. PATENT DOCUMENTS

| | | | | |
|---|---|---|---|---|
| 5,801,728 | A | 9/1998 | Yanagi et al. | 347/50 |
| 6,869,235 | B2 | 3/2005 | Kawaguchi et al. | 400/59 |
| 2007/0003355 | A1* | 1/2007 | Connors | B41J 13/103 400/693 |
| 2007/0182083 | A1* | 8/2007 | Asada | B65H 1/04 271/9.01 |
| 2018/0178562 | A1* | 6/2018 | Aoki | B41J 13/103 |
| 2019/0052766 | A1 | 2/2019 | Ishihara et al. | H04N 1/00615 |

FOREIGN PATENT DOCUMENTS

| | | |
|---|---|---|
| JP | H04-039259 | 2/1992 |

* cited by examiner

*Primary Examiner* — Henok D Legesse
(74) *Attorney, Agent, or Firm* — Venable LLP

(57) ABSTRACT

A printing apparatus includes a tray on which a sheet is to be stacked, a container configured to store the tray such that the tray can be pulled out, a first guide unit configured to guide a slide of the tray in a pull-out direction, a second guide unit spaced apart from the first guide unit in a widthwise direction, a first regulating portion provided in the container and configured to regulate, by abutting against the tray, a tilt of the tray to one direction in the widthwise direction; and a second regulating portion provided in the container and configured to regulate, by abutting against the tray, a tilt of the tray to the other direction in the widthwise direction.

15 Claims, 14 Drawing Sheets

PRINTING APPARATUS AND TRAY UNIT

BACKGROUND OF THE INVENTION

Field of the Invention

The present invention relates to a printing apparatus and a tray unit.

Description of the Related Art

A printing apparatus such as an inkjet printer is provided with a tray for stacking a print medium such as a print sheet and a tray for placing a printed medium. In order to reduce the space occupied by the printing apparatus, a structure has been proposed in which the tray can be stored when not in use. Japanese Patent Laid-Open No. 4-39259 discloses a structure in which the tray can be pulled out and stored by sliding it.

In the pull-out structure of the slide tray, when a user pushes the tray to set it in a stored state from a state in which the tray is pulled out, the tray may be tilted. If the tray is tilted largely, a force relationship is generated in which the tray expands the storage space in the widthwise direction, and the operability of the tray is deteriorated. The tray can be tilted when the position where the user pushes the tray is biased to the left or the right. Even if a handle is formed in a particular location of the tray, the user does not always use the handle, so that the tray can be tilted to either of the left and right directions.

SUMMARY OF THE INVENTION

The present invention provides a technique of improving the operability of a slide tray.

According to an aspect of the present invention, there is provided a printing apparatus that performs printing on a sheet, comprising: a tray on which the sheet is to be stacked; a container configured to store the tray such that the tray can be pulled out; a first guide unit configured to guide a slide of the tray from the container in a pull-out direction; a second guide unit spaced apart from the first guide unit in a widthwise direction of the tray and configured to guide the slide of the tray from the container in the pull-out direction; a first regulating portion provided in the container and configured to regulate, by abutting against the tray, a tilt of the tray to one direction in the widthwise direction; and a second regulating portion provided in the container and configured to regulate, by abutting against the tray, a tilt of the tray to the other direction in the widthwise direction.

Further features of the present invention will become apparent from the following description of exemplary embodiments (with reference to the attached drawings).

DESCRIPTION OF THE EMBODIMENT

Figure 1:
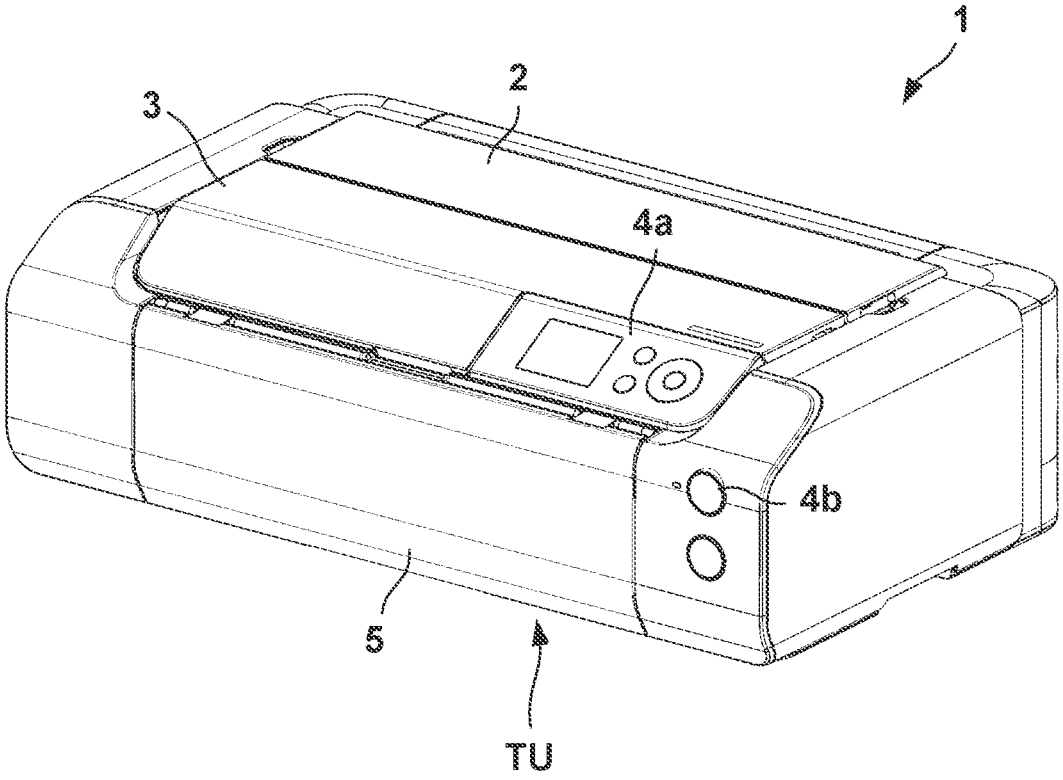
FIG. 1 is an external view of a printing apparatus according to an embodiment of the present invention.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

<Printing Apparatus>

FIG. 1 is an external view of a printing apparatus 1 according to an embodiment of the present invention. The printing apparatus 1 is a serial inkjet printing apparatus, and an apparatus that prints an image by discharging ink onto a print medium. However, the present invention is also applicable to a printing apparatus of another type.

Note that "printing" includes not only forming significant information such as characters and graphics but also forming images, figures, patterns, and the like on print media in a broad sense, or processing print media, regardless of whether the information formed is significant or insignificant or whether the information formed is visualized so that a human can visually perceive it. In addition, although in this embodiment, sheet-like paper is assumed as a "print medium", cloth, plastic film, and the like may be used as print media.

Figure 2:
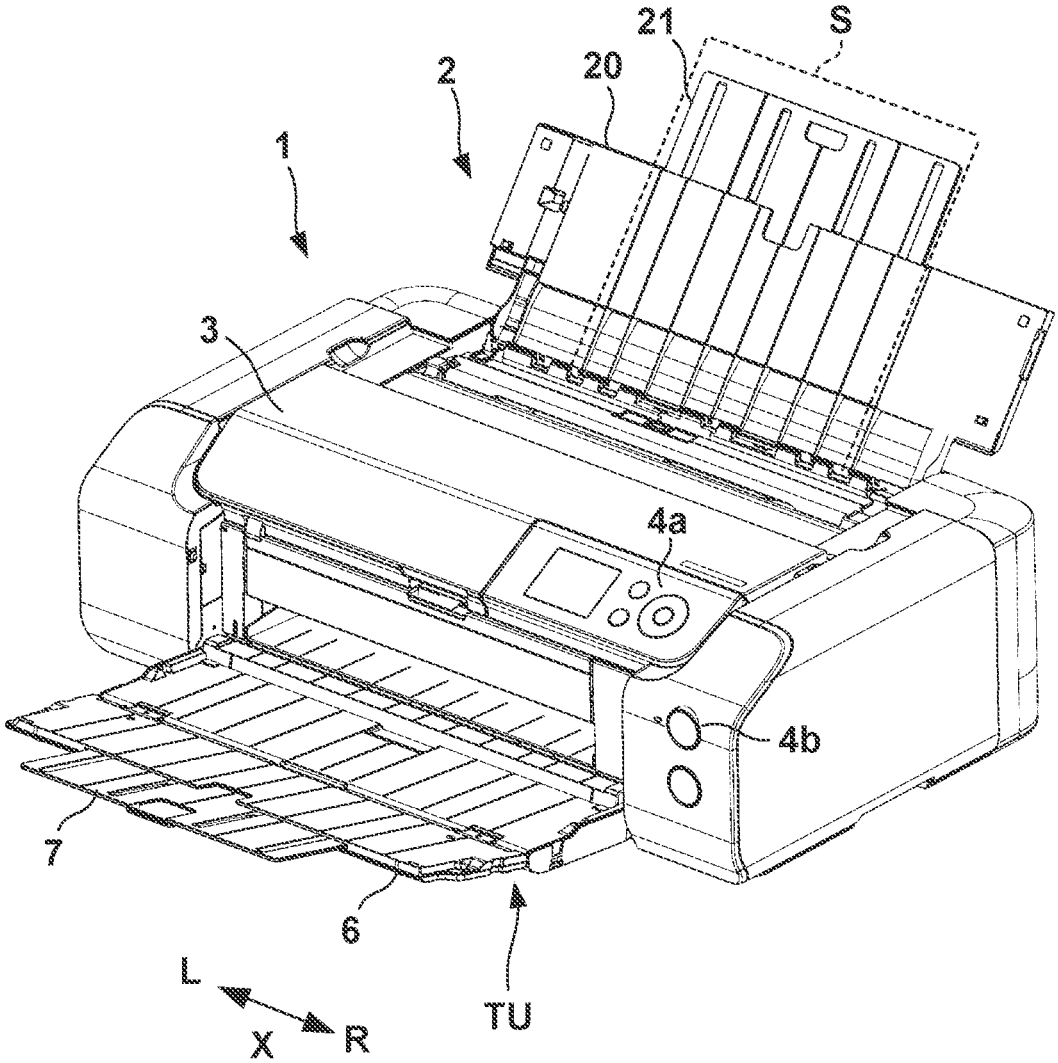
FIG. 2 is a view showing an extended state of a feeding tray.

The printing apparatus 1 is provided with a feeding tray unit 2, an access cover 3, an operation panel 4*a*, a power supply button 4*b*, and a discharging tray unit TU. The feeding tray unit 2 is provided so as to be extendable, and FIG. 1 shows the feeding tray unit 2 in a stored state. FIG. 2 shows the feeding tray unit 2 in an extended state. The feeding tray unit 2 includes a tray 20 and a tray 21 which is stored in the tray 20 so as to be pulled out. As shown in FIG. 2, an unprinted print medium S on which an image is to be printed is stacked on the feeding tray unit 2 in the extended state.

The access cover 3 is provided such that it can be opened and closed, and FIG. 1 shows the access cover 3 in a closed state. When the access cover 3 is set in an open state, the internal structure of the printing apparatus 1 is exposed. A carriage on which an ink tank is mounted, a printhead which is supported by the carriage and discharges ink, a driving mechanism which reciprocates the carriage in the main scanning direction, a conveyance mechanism which conveys the print medium S in the sub-scanning direction, a control circuit, and the like are provided inside the printing apparatus 1. When the access cover 3 is set in the open state, an operation of replacing the ink tank can be performed.

Figure 3:
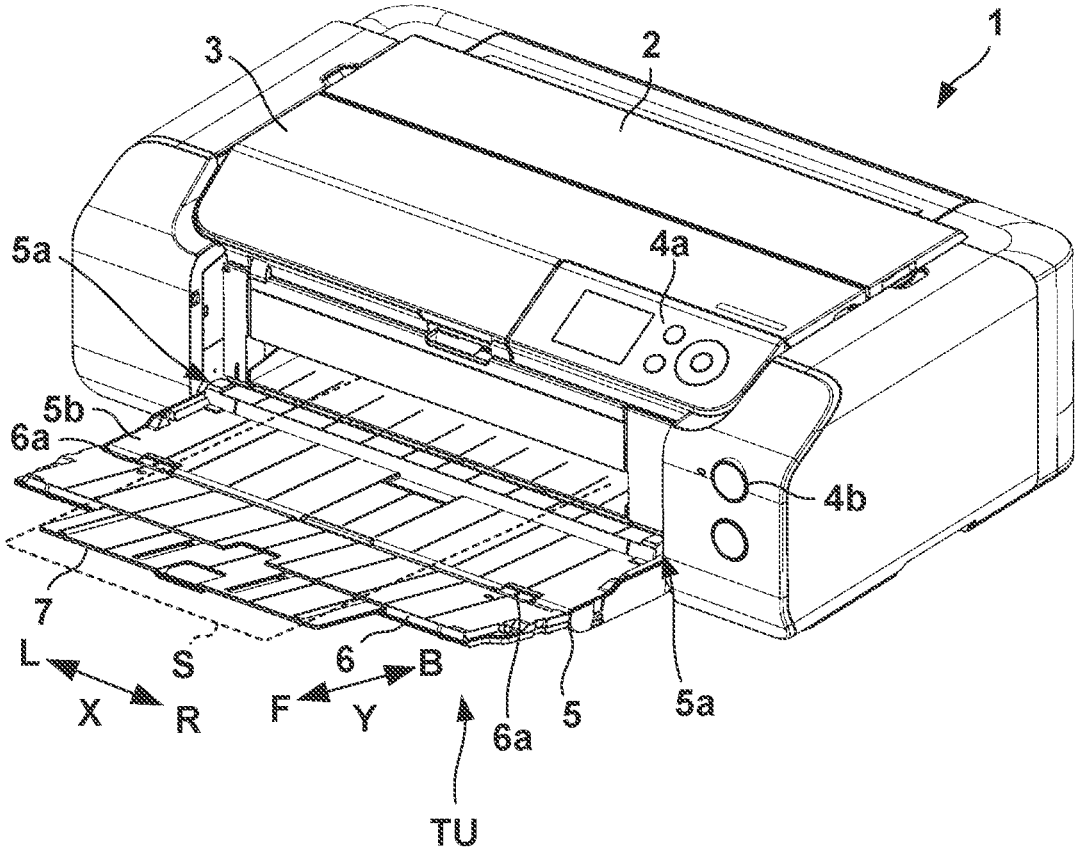
FIG. 3 is a view showing a state in which a tray unit of the printing apparatus shown in FIG. 1 is extended.

The operation panel 4*a* includes buttons which accept user operations, and a display unit which provides information to the user. The power supply button 4*b* accepts, from the user, an on/off operation of the power supply of the printing apparatus 1. The discharging tray unit TU includes a front door 5. The discharging tray unit TU is provided such that it can be extended, with a rotation shaft portion 5*a* as the pivot center, from a stored state in which the front door 5 forms the external appearance of the apparatus 1 as shown in FIG. 1 to an extended state shown in FIG. 3.

The discharging tray unit TU includes a tray 5*b* formed on the back side of the front panel 5, a tray 6 pivotably connected to the tray 5*b* via hinge portions 6*a*, and a tray 7 which can be pulled out from the tray 6. An arrow Y indicates the pull-out direction of the tray 7, reference symbol B indicates the far side (storage side), and reference symbol F indicates the near side (pull-out side). The pull-out direction Y is a direction parallel to the stacking surface of the tray 6 and the stacking surface of the tray 7. An arrow X indicates the widthwise direction of the tray 6 and the widthwise direction of the tray 7, and also indicates the widthwise direction of the apparatus 1. Reference symbol L indicates one side (for example, left side) in the widthwise direction X, and reference symbol R indicates the other side (for example, right side) in the widthwise direction X. The pull-out direction Y and the widthwise direction X intersect each other, and they are orthogonal to each other in this embodiment.

Figure 4A:
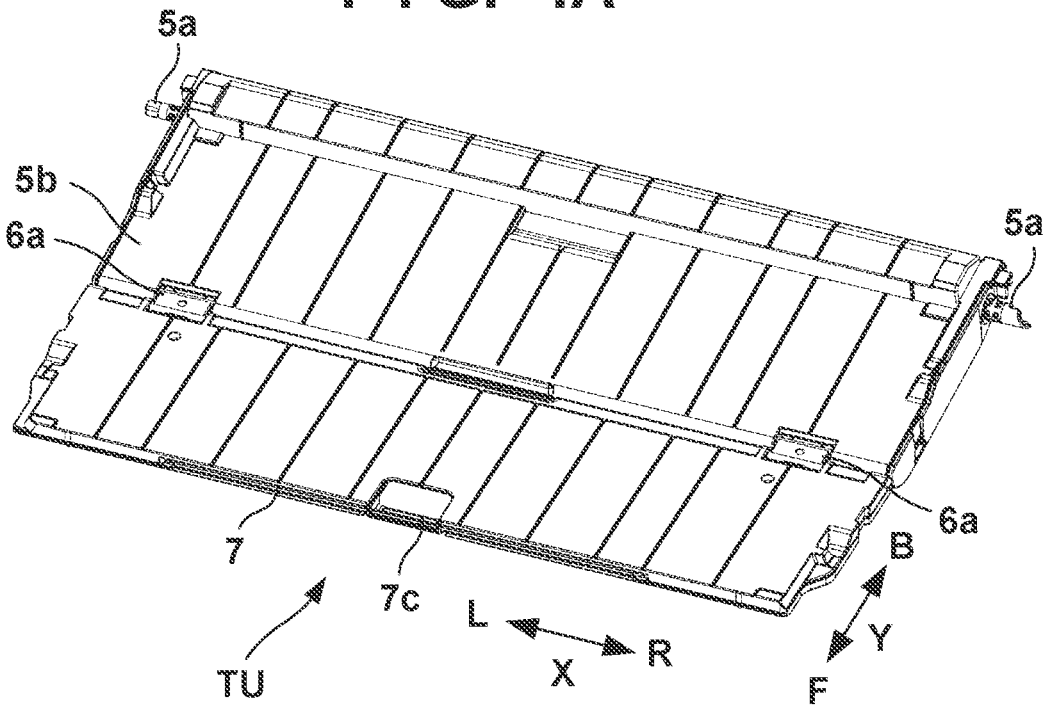
FIG. 4A is a view showing a stored mode of a tray.
Figure 4B:
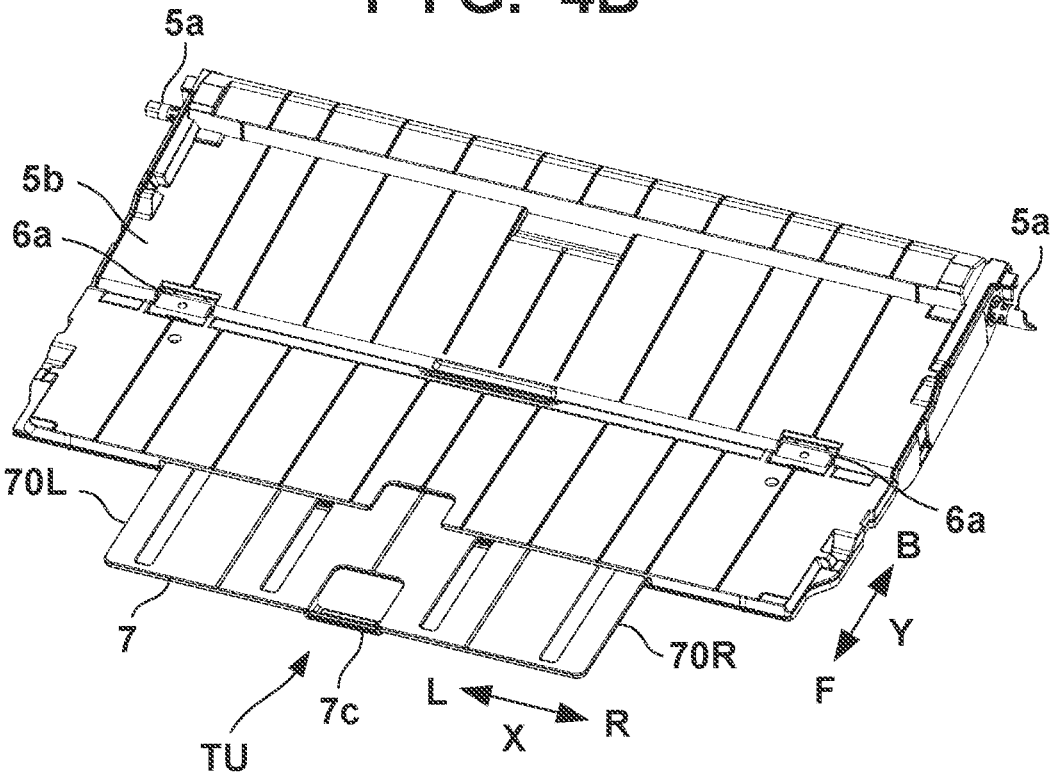
FIG. 4B is a view showing a pulled-out mode of the tray.

Each of FIGS. 4A and 4B shows a perspective view of the tray unit TU. FIG. 4A shows a state in which the tray 7 is stored in the tray 6, and FIG. 4B shows a state in which the tray 7 is pulled out from the tray 6. For example, when the print medium S whose length in the discharge direction is small is used, the tray 7 is used in the stored state shown in FIG. 4A, and when the print medium S whose length in the discharge direction is large is used, the tray 7 is used in the pulled-out state shown in FIG. 4B. A handle 7*c* is formed in the end portion of the tray 7 on the F side in the Y direction and in the center portion in the X direction. By holding the handle 7*c* (finger hook), the user can easily perform the pull-out/storage operation of the tray 7.

The tray 5*b*, the tray 6, and the tray 7 form a stacking portion on which the print medium S discharged from the inside of the apparatus 1 is stacked. In general, the print medium S discharged from the inside of the apparatus 1 is a print medium having undergone printing on which an image has been printed. When the discharging tray unit TU is stored, the tray 7 is stored in the tray 6, the tray 6 is folded onto the tray 5*b* using the hinge portions 6*a*, and then the whole discharging tray unit TU is pivoted around the rotation shaft portion 5*a* and set in the state shown in FIG. 1.

Figure 5A:
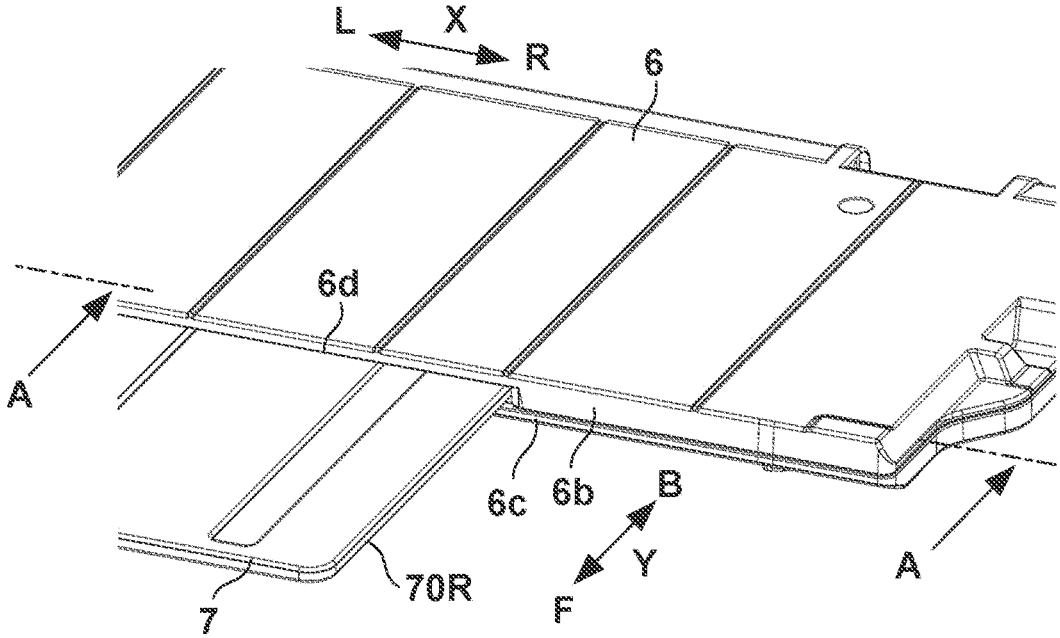
FIG. 5A is a partially enlarged perspective view of the tray.
Figure 5B:
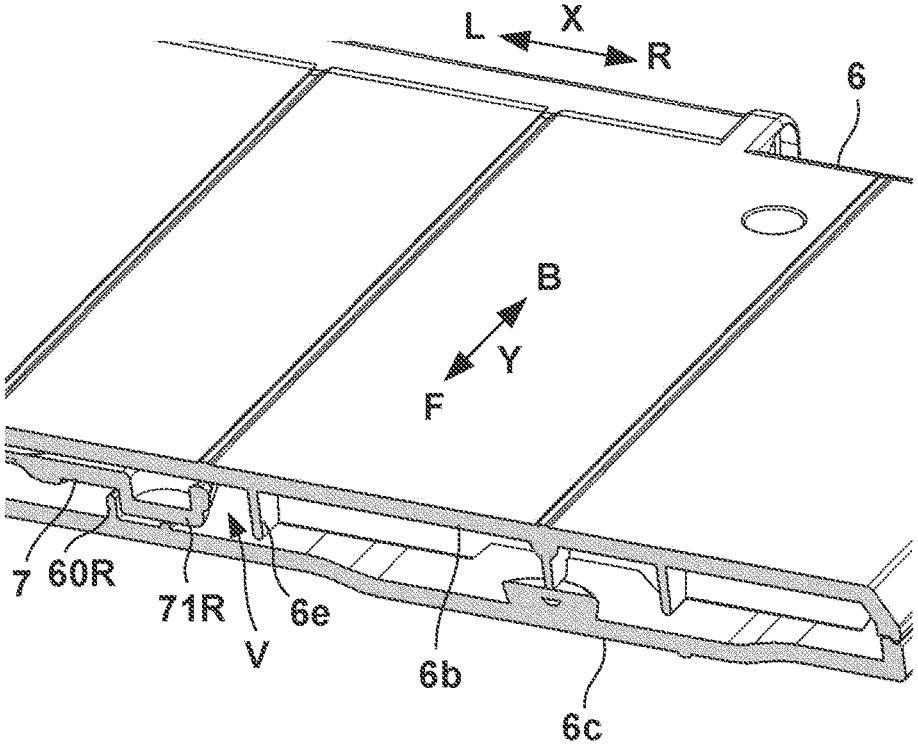
FIG. 5B is a sectional view taken along a line A-A in FIG. 5A.

With reference to FIGS. 5A to 8B, the pull-out/storage structure of the tray 7 will be described. FIG. 5A shows a state in which the tray 7 is pulled out from the tray 6, and FIG. 5B is a sectional view taken along a line A-A in FIG. 5A. The tray 6 forms a container of the tray 7. The tray 6 is a hollow body formed by vertically stacking a base 6*c* forming the lower side and a cover 6*b* forming the upper side, and includes a storage space V of the tray 7 inside. The storage space V is open (opening portion 6*d*) in the F-side end portion of the tray 6 in the Y direction. The tray 7 is a rectangular plate-shaped member as a whole, and includes a pair of side surfaces 70R and 70L. The pair of side surfaces 70R and 70L are extended in the Y direction so as to be parallel to each other.

Figure 6:
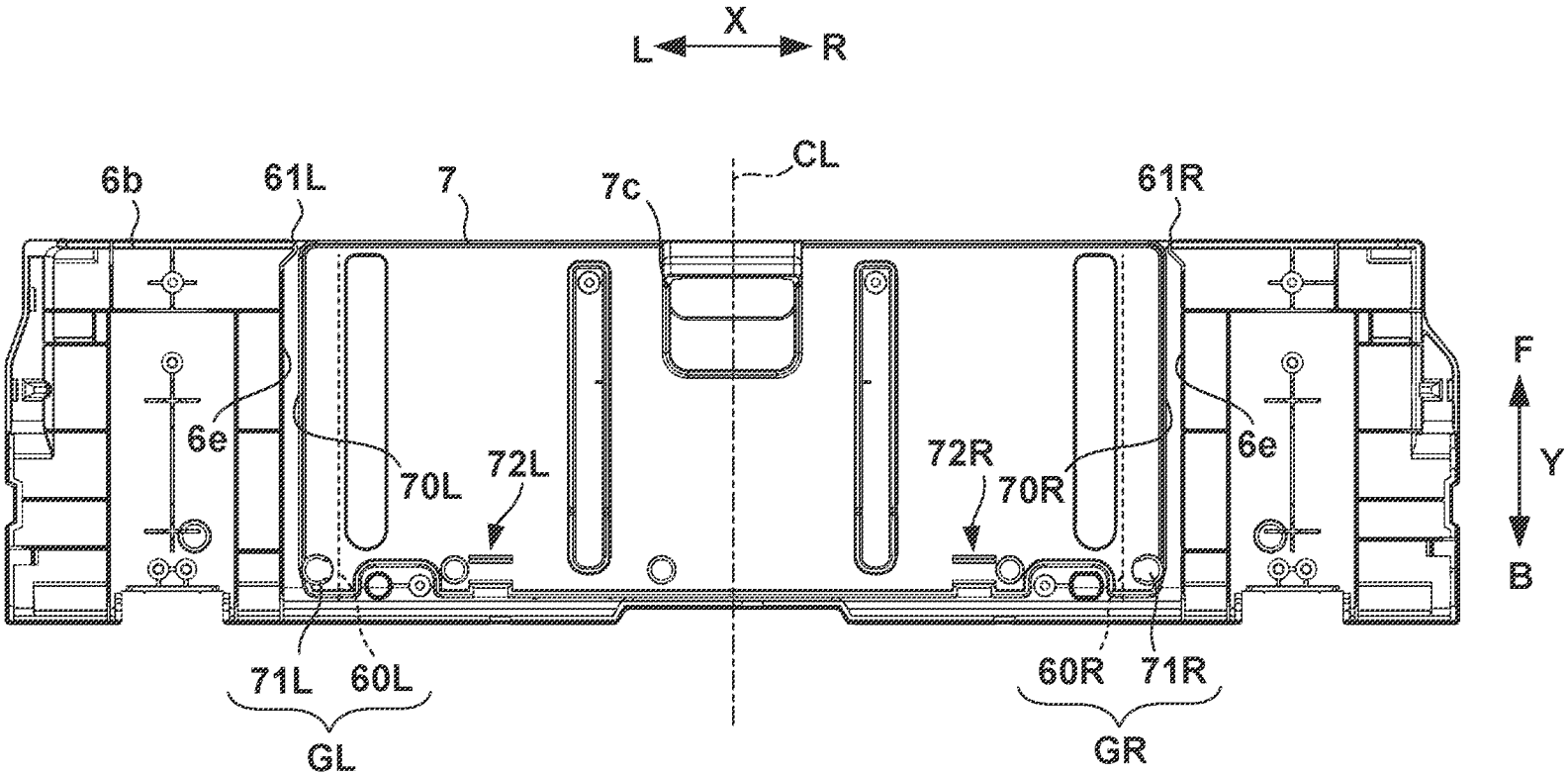
FIG. 6 is a bottom view showing the main part of the tray unit (stored mode)
Figure 7:
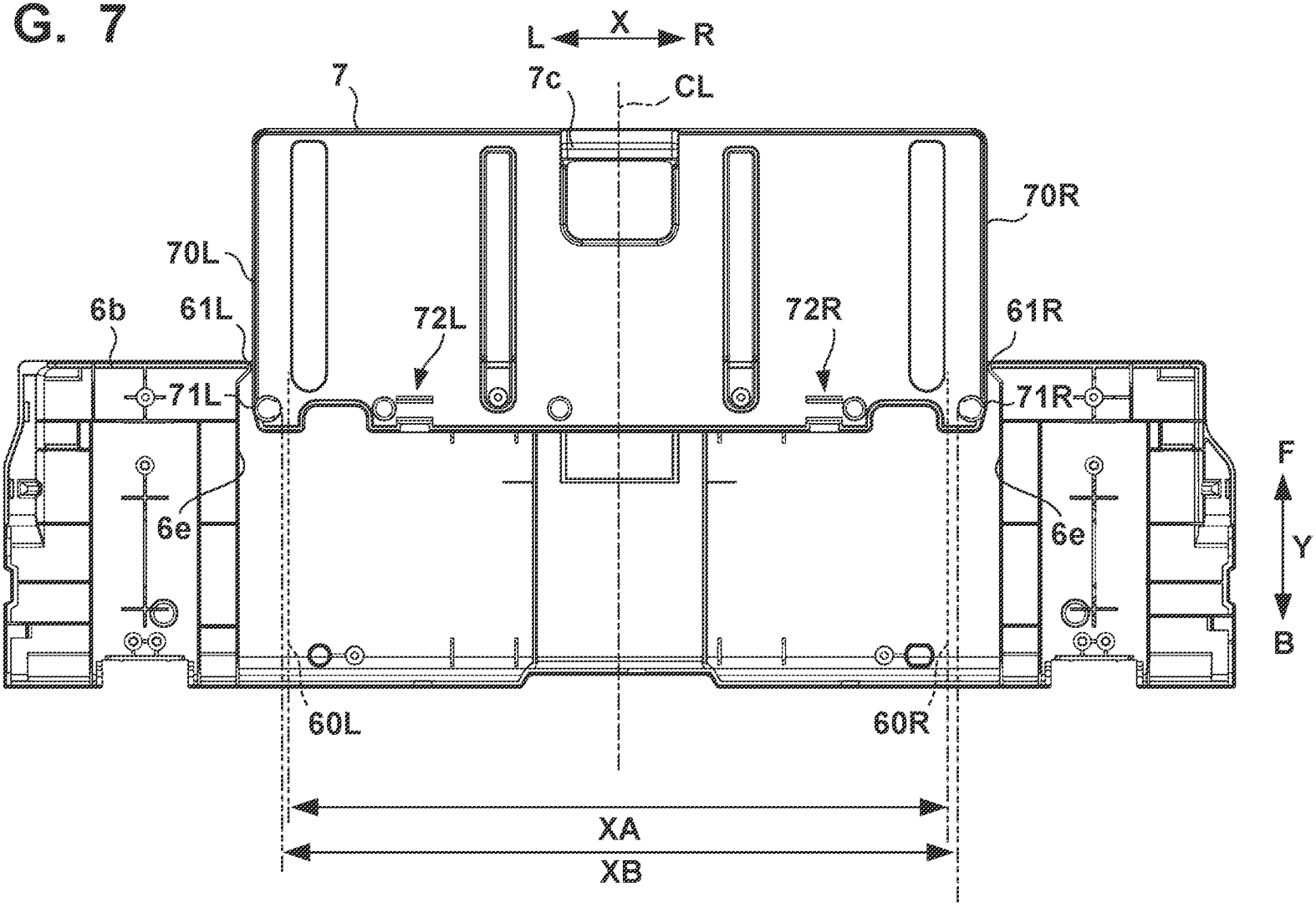
FIG. 7 is a bottom view showing the main part of the tray unit (extended mode)
Figure 8A:
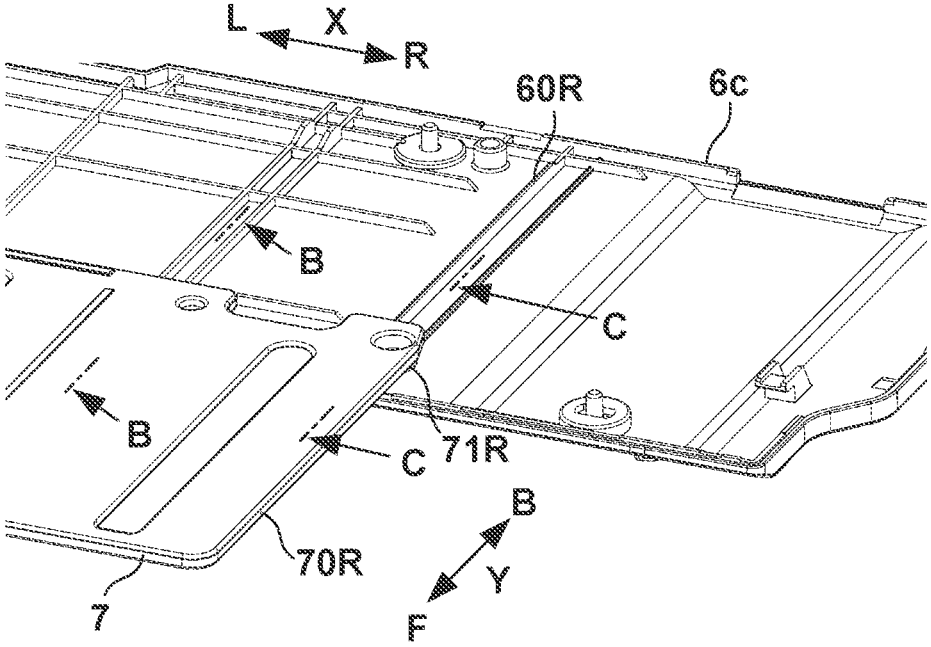
FIGS. 8A and 8B are perspective views each showing the main part of the tray unit (extended mode)
Figure 8B:
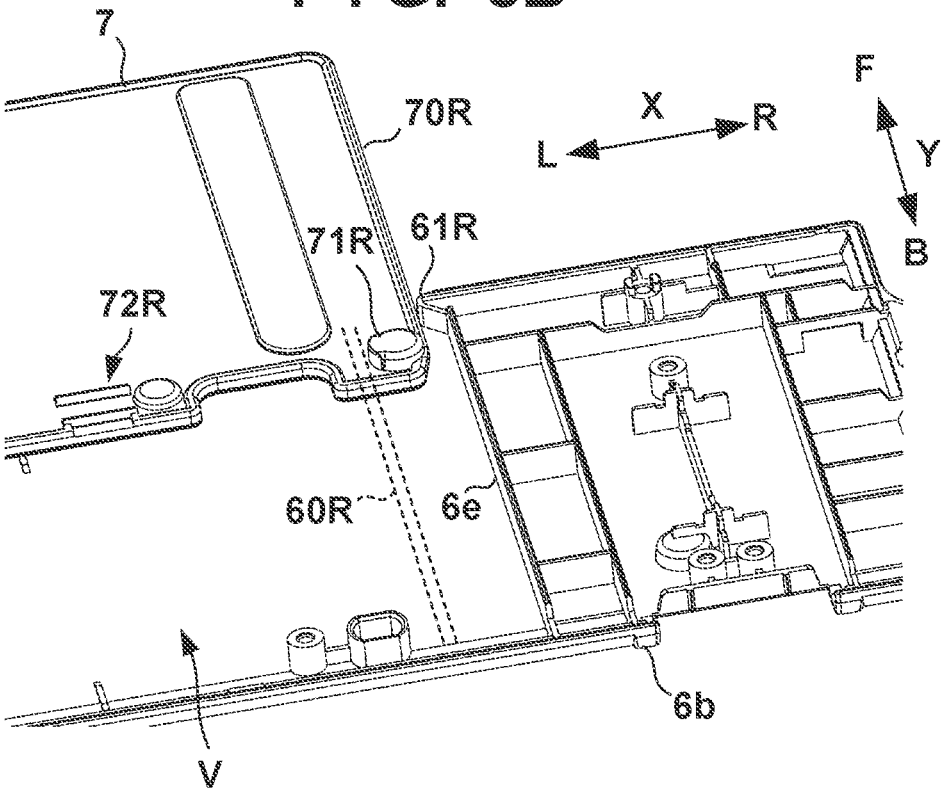

The tray 7 is provided in the storage space V such that it can be slid in the Y direction. Each of FIGS. 6 and 7 is a view showing the tray 6 and the tray 7 when viewed from below, and shows the cover 6*b* alone among the components of the tray 6. FIG. 6 shows the stored state, and FIG. 7 shows the pulled-out state. A center line CL is the center line of each of the trays 6 and 7 in the X direction. FIG. 8A is a view showing the tray 6 and the tray 7 when viewed from above, and shows the base 6*c* alone among the components of the tray 6. FIG. 8B is a view showing the tray 6 and the tray 7 when viewed from below, and shows the cover 6*b* alone among the components of the tray 6. Both of FIGS. 8A and 8B show the pulled-out state.

The tray unit TU includes a guide structure GR and a guide structure GL that guide the slide of the tray 7 from the tray 6 in the pull-out direction. The guide structure GR and the guide structure GL are spaced apart from each other in the X direction, and arranged symmetrically with respect to the center line CL.

The guide structure GR includes a guide portion 60R extended in the Y direction, and a slide contact portion 71R that can abut against the guide portion 60R in the X direction. In this embodiment, the guide portion 60R is formed on the tray 6, and the slide contact portion 71R is formed on the tray 7, but this arrangement may be reversed. In this embodiment, the guide portion 60R is a rib having a rectangular section, and the side surface thereof forms a slide contact surface which guides the slide contact portion 71R. In this embodiment, the slide contact portion 71R is a cylindrical body, and arranged such that its peripheral surface can abut against the guide portion 60R in the X direction. The slide contact portion 71R is located on the outer side (R side) of the guide portion 60R in the X direction.

The guide structure GL has the structure similar to that of the guide structure GR. That is, the guide structure GL includes a guide portion 60L extended in the Y direction, and a slide contact portion 71L that can abut against the guide portion 60L in the X direction. In this embodiment, the guide portion 60L is formed on the tray 6, and the slide contact portion 71L is formed on the tray 7. However, this arrangement may be reversed. In this embodiment, the guide portion 60L is a rib having a rectangular section, and the side surface thereof forms a slide contact surface which guides the slide contact portion 71L. In this embodiment, the slide contact portion 71L is a cylindrical body, and arranged such that its peripheral surface can abut against the guide portion 60L in the X direction. The slide contact portion 71L is located on the outer side (L side) of the guide portion 60L in the X direction.

With the arrangement described above, the tray 7 can be slid in the Y direction while being guided by the guide structure GR and the guide structure GL. The relationship between a X-direction distance XA between the slide contact surface of the guide portion 60R and the slide contact surface of the guide portion 60L and a X-direction distance XB between the inner end of the slide contact portion 71R and the inner end of the slide contact portion 71L is expressed by XB>XA. That is, there is always a slight gap between the guide portion 60R and the slide contact portion 71R or between the guide portion 60L and the slide contact portion 71L, so that it is possible to slide the tray 7 smoothly in the Y direction.

Regulating portions 61R and 61L are formed on the tray 6. The regulating portion 61R abuts against the tray 7, thereby regulating a tilt of the tray 7 to the R direction in the X direction. The regulating portion 61L abuts against the tray 7, thereby regulating the tilt of the tray 7 to the L direction in the X direction. By providing the regulating portions 61R and 61L, a large tilt of the tray 7 at the time of sliding the tray 7 is suppressed, and the tray 7 can be slid smoothly.

The regulating portion 61R according to this embodiment is a convex portion protruding inward (the side of the center line CL) in the X direction from one side wall 6*e* in the X direction, which defines the storage space V. Similarly, the regulating portion 61L according to this embodiment is a convex portion protruding inward (the side of the center line CL) in the X direction from the other side wall 6*e* in the X direction, which defines the storage space V. The regulating portion 61R and the regulating portion 61L are spaced apart from each other in the X direction, and arranged symmetrically with respect to the center line CL. This symmetrical arrangement facilitates centering of the tray 7 with respect to the center line CL.

The regulating portion 61R according to this embodiment is arranged so as to abut against the side surface 70R of the tray 7 in the X direction. The part where the regulating portion 61R abuts against is not limited to the side surface 70R, but if the side surface 70R serves as the abutted part, it is possible to suppress a tilt of the tray 7 at an arbitrary position of the tray 7 in the Y direction. Similarly, the regulating portion 61L according to this embodiment is arranged so as to abut against the side surface 70L of the tray 7 in the X direction. The part where the regulating portion 61L abuts against is not limited to the side surface 70L, but if the side surface 70L serves as the abutted part, it is possible to suppress a tilt of the tray 7 at an arbitrary position of the tray 7 in the Y direction.

The regulating portions 61R and 61L are arranged in the end portions of the tray 6 on the near side in the Y direction and, particularly, form wall portions which define the opening portion 6*d*. It is possible to suppress a tilt of the tray 7 at an arbitrary position of the tray 7 in the X direction.

The arrangement of the guide structures GR and GL and the regulating portions 61R and 61L will be described. The guide structures GR and GL are located between the regulating portion 61R and the regulating portion 61L in the X direction. The overall structure can be constructed without difficulty. Regardless of the position of the tray 7 with respect to the tray 6 in the Y direction, the slide contact portions 71R and 71L are located at positions shifted from the regulating portions 61R and 61L, respectively, in the Y direction. When sliding the tray 7, if the tray 7 is tilted, the slide contact portion 71R or the slide contact portion 71L tends to be the center of rotation. Since the regulating portions 61R and 61L are always spaced apart from the slide contact portions 71R and 71L, respectively, if the tray 7 is tilted, the regulating portions 61R and 61L make it easier to apply a moment in the direction of correcting the tilt of the tray 7, so that it is possible to suppress an increase in tilt of the tray 7. Particularly, in this embodiment, regardless of the position of the tray 7 with respect to the tray 6 in the Y direction, the slide contact portions 71R and 71L are located on the B side of the regulating portions 61R and 61L, respectively, in the Y direction. Regardless of the position of the tray 7 in the Y direction, the regulating portions 61R and 61L make it easier to apply a moment in the direction of correcting the tilt of the tray 7, so that it is possible to suppress an increase in tilt of the tray 7.

Figure 10A:
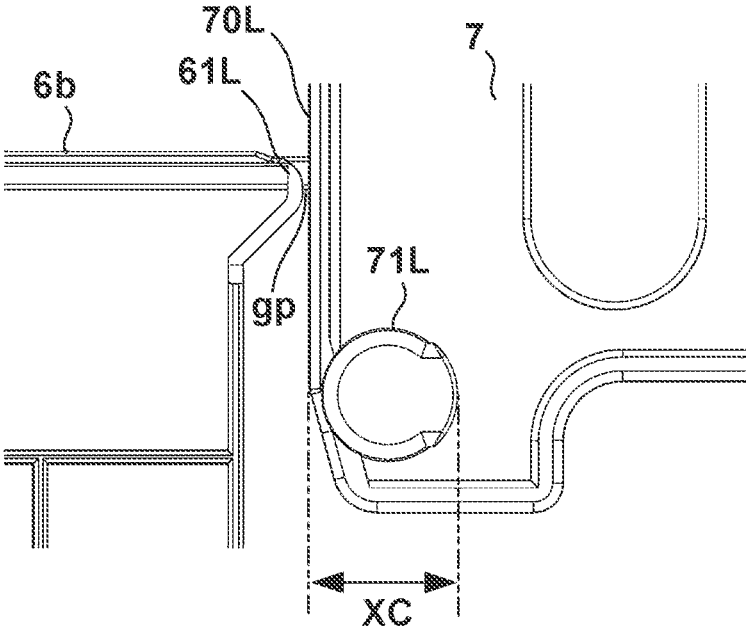
FIGS. 10A and 10B are views for explaining the state in which the tray is tilted.
Figure 10B:
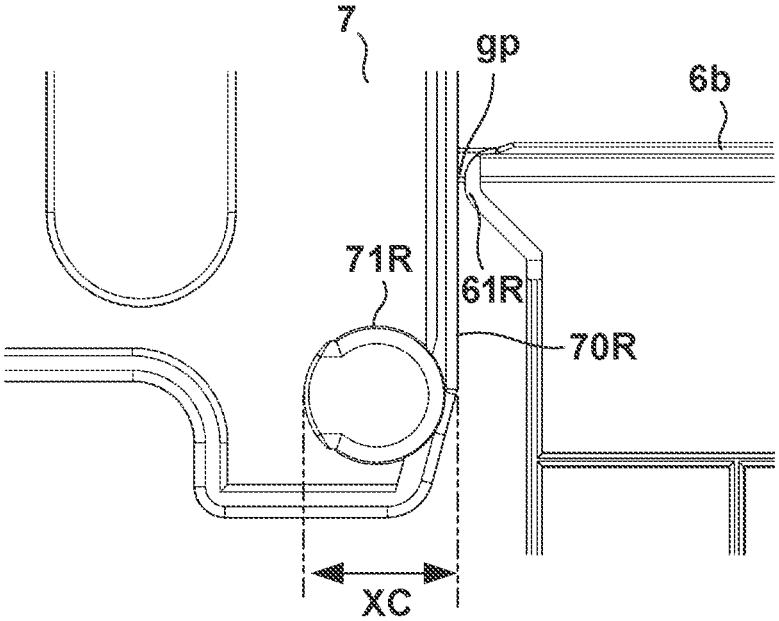

The tilt of the tray 7 and the pull-out operation and storage operation thereof will be described. In the stored state of the tray 7, the tray 7 is hidden in the tray 6 except for the handle 7*c* (FIG. 4A). Therefore, the user is guided to pull out the tray 7 using the handle 7*c*. If the user pulls the tray 7 using the handle 7*c* arranged at the center of the tray 7 in the X direction, the tray 7 is pulled straight. At this time, as shown in FIGS. 10A and 10B, there are gaps gp between the regulating portion 61R and the side surface 70R and between the regulating portion 61L and the side surface 70L.

Figure 9A:
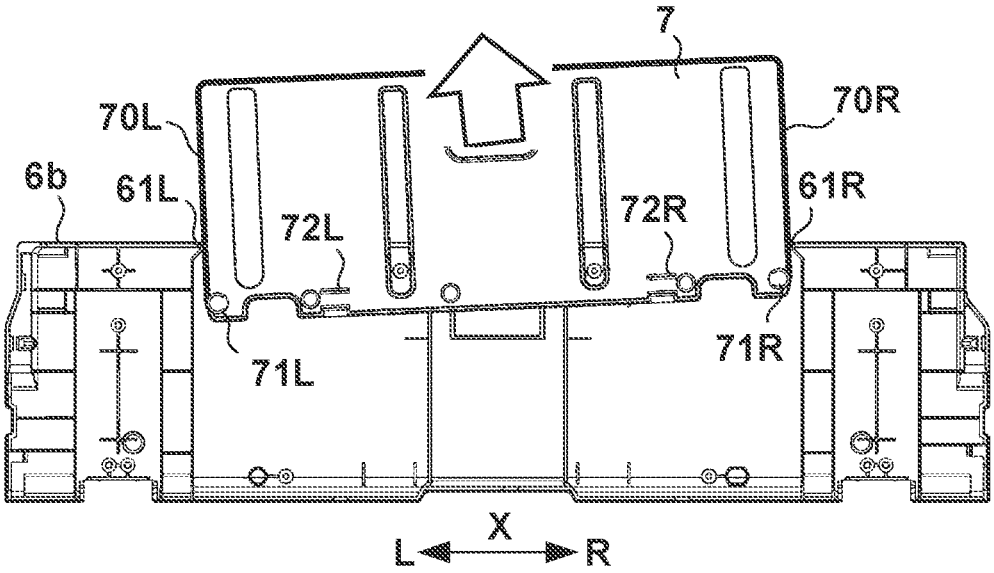
FIGS. 9A and 9B are views each for explaining a state in which the tray is tilted.
Figure 11A:
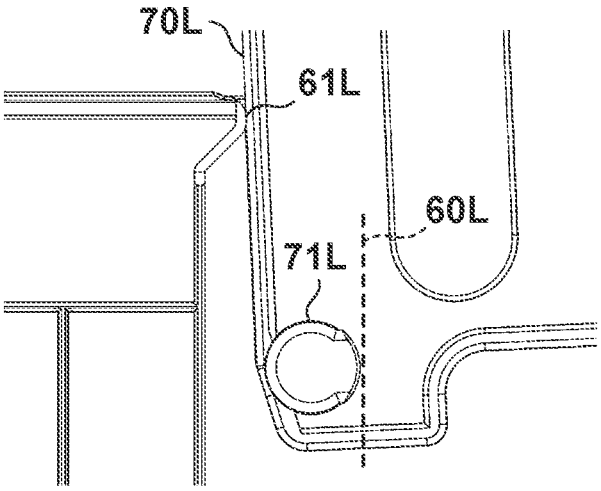
FIGS. 11A and 11B are views for explaining the state in which the tray is tilted.
Figure 11B:
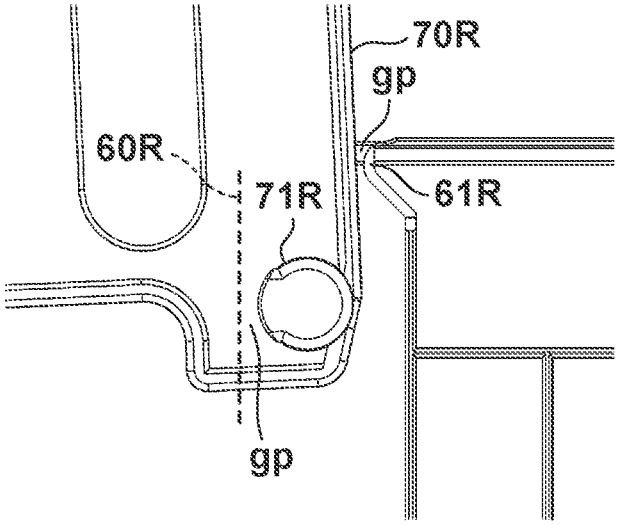

Even if the tray 7 is tilted as shown in FIG. 9A, the regulating portion 61L abuts against the side surface 70L as shown in FIG. 11A, so that the tilt of the tray 7 is suppressed. On the opposite side, there are the gaps gp between the regulating portion 61R and the side surface 70R and between the slide contact portion 71R and the guide portion 60R as shown in FIG. 11B, so that the tray 7 can be pulled smoothly with a small operation force.

Figure 9B:
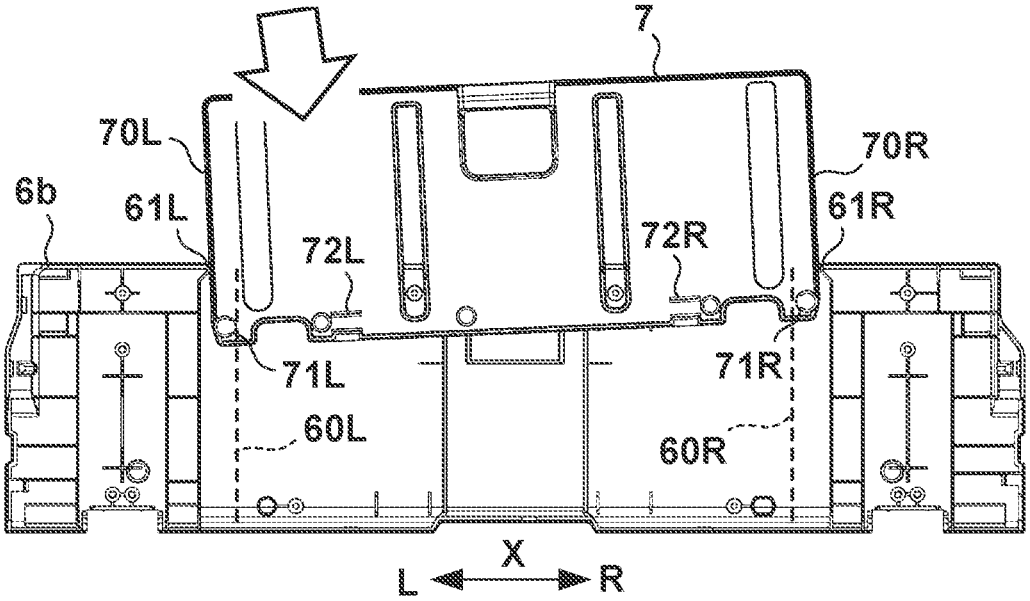

At the time of a storage operation of the tray 7, a position shifted from the handle 7*c* in the X direction may be pushed as shown in FIG. 9B. In the example shown in FIG. 9B, a position of the tray 7 shifted from the handle 7*c* to the L side in the X direction is pushed. Also in this case, as shown in FIGS. 11A and 11B, the regulating portion 61L abuts against the side surface 70L, so that the tilt of the tray 7 is suppressed. On the opposite side, since there is the gap gp between the regulating portion 61R and the side surface 70R and there is the gap gp between the slide contact portion 71R and the guide portion 60R, the tray 7 can be smoothly stored with a small operation force.

As has been described above, in this embodiment, the regulating portion 61R is arranged so as to abut against the side surface 70R of the tray 7 before both the slide contact portions 71R and 71L of the guide structures GR and GL abut against the corresponding guide portions 60R and 60L when the tray 7 is tilted to the R side. Similarly, the regulating portion 61L is arranged so as to abut against the side surface 70L of the tray 7 before both the slide contact portions 71R and 71L of the guide structures GR and GL abut against the corresponding guide portions 60R and 60L when the tray 7 is tilted to the L side.

Figure 12A:
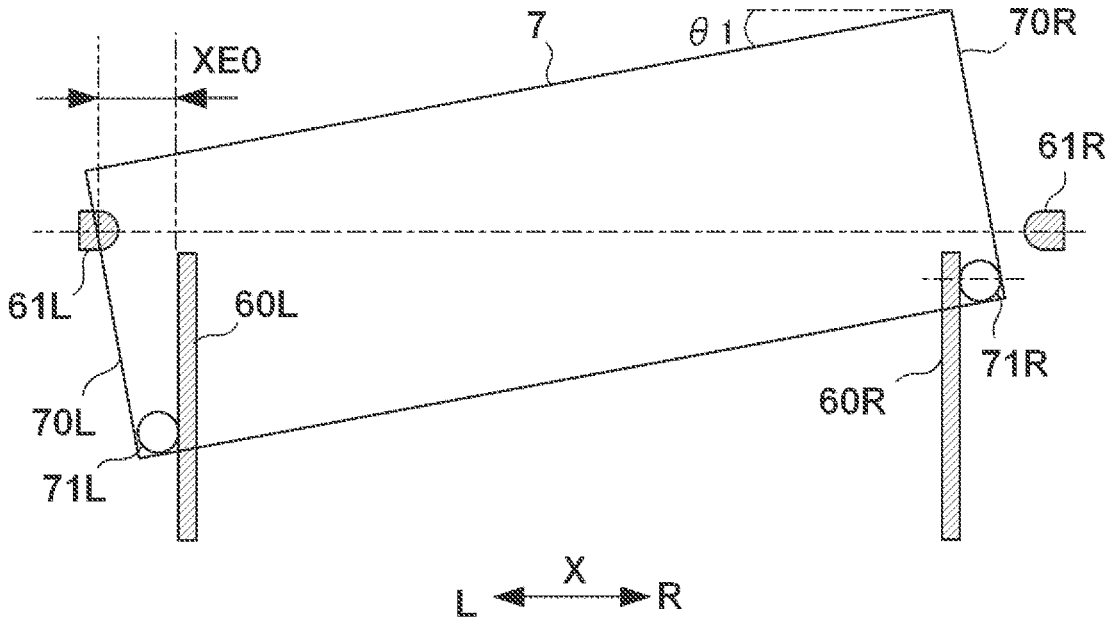
FIGS. 12A and 12B are views for explaining an example of dimensional design of the tray.

An example of dimensional design for the arrangement described above will be described with reference to FIGS. 12A and 12B. FIG. 12A shows a state in which the tray 7 is tilted by an angle θ1 at the position where the tray 7 is pulled out to the maximum. FIG. 12A schematically shows a state in which the slide contact portion 71L abuts against the guide portion 60L and the slide contact portion 71R abuts against the guide portion 60R. In the state in which the slide contact portion 71L abuts against the guide portion 60L and the slide contact portion 71R abuts against the guide portion 60R, a force relationship is generated in which the guide portions 60R and 60L expand the tray 7 in the X direction, so that the slide of the tray 7 becomes heavy. Since FIG. 12A shows a virtual example, the side surface 70L of the tray 7 is located on the left side of the side surface of the regulating portion 61L. Let XE0 be the distance between the slide contact surface of the guide portion 60L and the side surface 70L on the abutting line with the regulating portion 61L at this time.

Figure 12B:
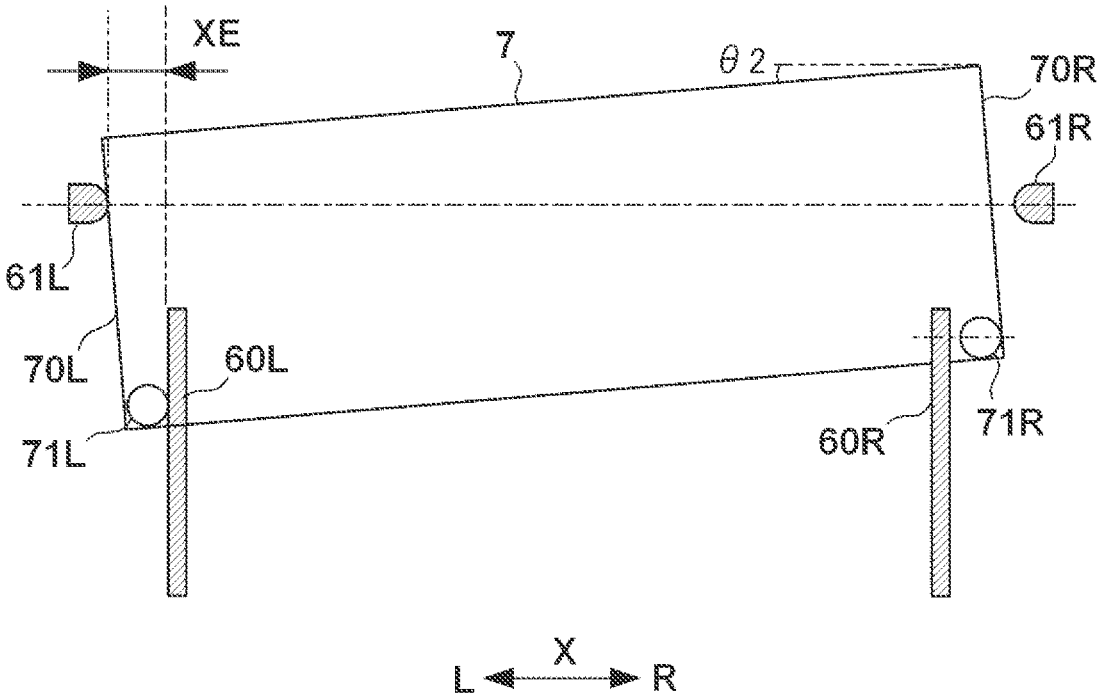

FIG. 12B shows a state in which the tray 7 is rotated clockwise, with the slide contact portion 71L as the center of rotation, from the state shown in FIG. 12A to the position where the regulating portion 61L abuts against the side surface 70L. Note that in this rotation, the position of the slide contact portion 71R in the Y direction is maintained in the state in which the tray 7 is pulled out to the maximum.

At this time, the slide contact portion 71R is spaced apart from the guide portion 60R. The tray 7 is tilted by an angle θ2 (<θ1). Let XE be the distance between the slide contact surface of the guide portion 60L and the side surface 70L on the abutting line with the regulating portion 61L at this time. The relationship expressed by XE<XE0 holds.

The relationship among the above-described distances XA and XB, distances XC between the slide contact points of the slide contact portions 71L and 71R with respect to the guide portions 61L and 61R and the side surfaces 70L and 70R shown in FIGS. 10A and 10B, respectively, and the distance XE is expressed as (XB−XA)+XC<XE. Therefore, by designing the dimension so as to satisfy the relationship expressed by (XB−XA)+XC<XE<XE0, it is possible to avoid a state in which the slide contact portion 71L abuts against the guide portion 60L and the slide contact portion 71R abuts against the guide portion 60R.

Figure 13A:
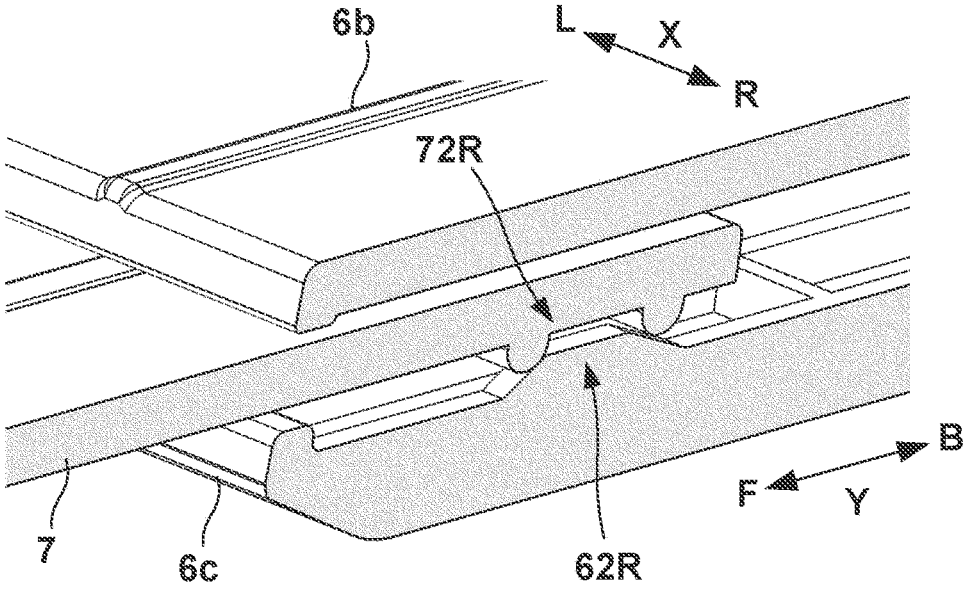
FIG. 13A is a sectional view taken along a line B-B in FIG. 8A.

Next, the lock structure for holding the tray 7 at the pulled-out position where the tray 7 pulled out to the maximum is located will be described. As shown in FIGS. 6 and 8B and the like, engaging portions 72R and 72L are formed in the end portions of the tray 7 on the B side. FIG. 13A will be referred to. FIG. 13A is a sectional view taken along a line B-B in FIG. 8A. The engaging portion 72R is formed by two ribs extending in the X direction, and a concave portion is formed between the two ribs. An engaging portion 62R which engages with the engaging portion 72R is formed on the base 6*c* of the tray 6. The engaging portion 62R is a convex portion having a trapezoidal section. When the engaging portion 62R enters the concave portion of the engaging portion 72R as shown in FIG. 13A, they are set in an engaged state. When the tray 7 is pushed in the storage direction, the engaging portion 72R rides on the engaging portion 62R, and the engagement between them is released. The engaging portion 72L and a corresponding engaging portion 62L (shown in FIG. 14) have the structure similar to the structure described above.

Figure 13B:
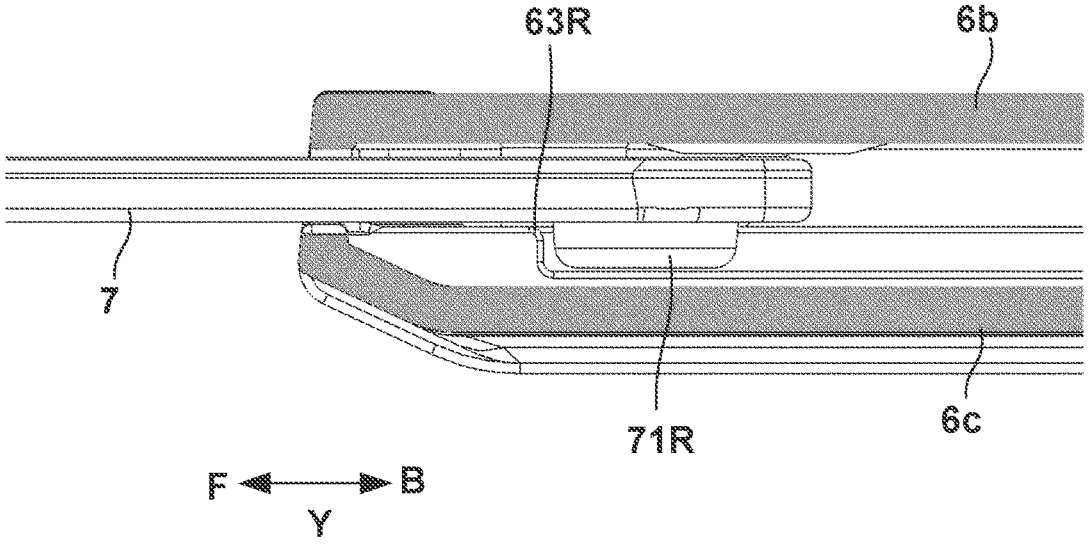
FIG. 13B is a sectional view taken along a line C-C in FIG. 8A.

FIG. 13B will be referred to. FIG. 13B is a sectional view taken along a line C-C in FIG. 8A. The base 6*c* is provided with a stopper 63R which regulates that the tray 7 is further pulled out beyond the position where the tray 7 pulled out to the maximum is located. The stopper 63R is a rib extending in the X direction, and abuts against the slide contact portion 71R to prevent the tray 7 from being further pulled out. A stopper 63L (shown in FIG. 14) which abuts against the slide contact portion 71L is also provided.

Figure 14:
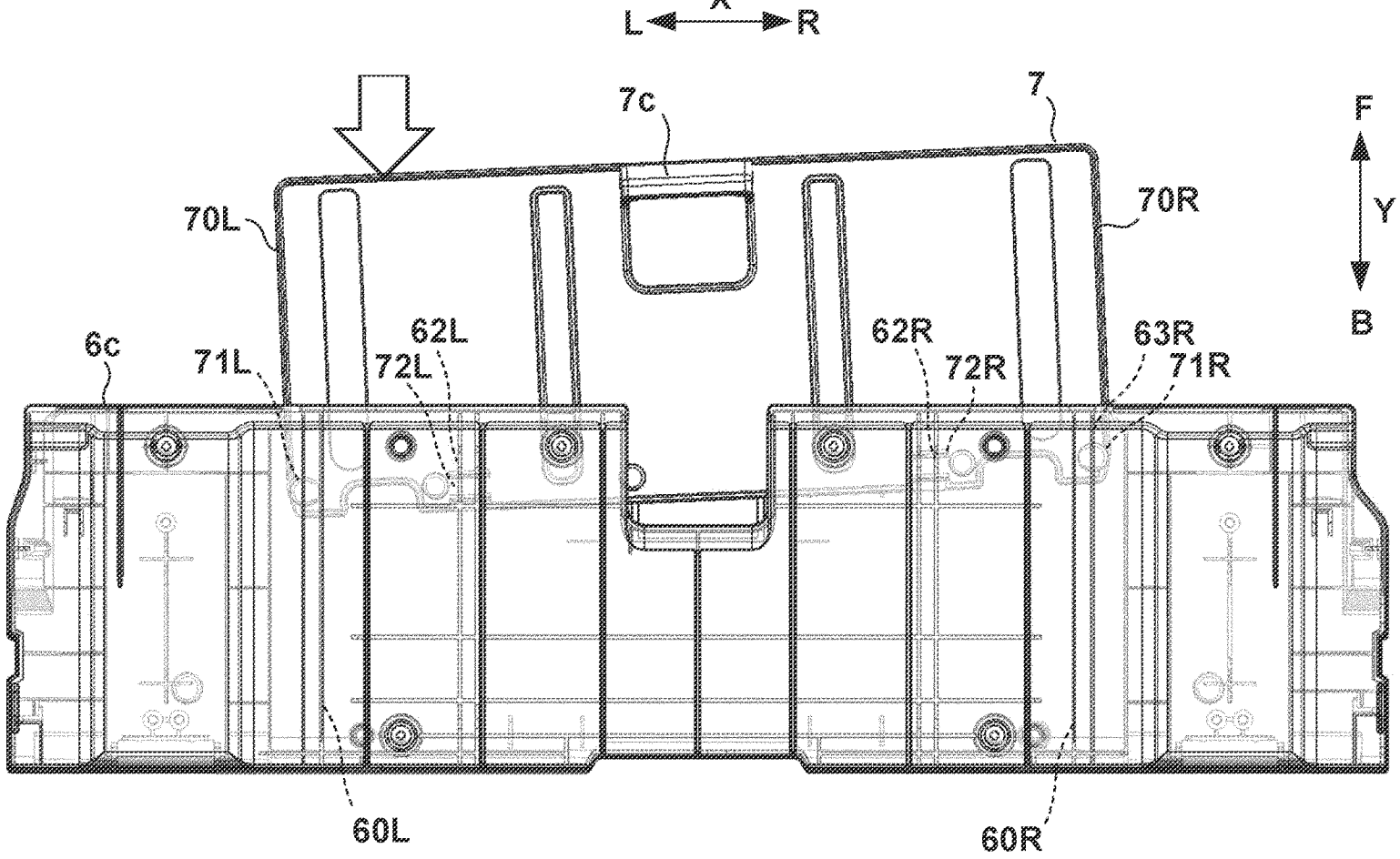
FIG. 14 is a view for explaining the state in which the tray is tilted.

Next, the functions of the lock structure and the stoppers 63R and 63L when the pulled-out tray 7 is pushed in the storage direction in the tilted state will be described with reference to FIG. 14. FIG. 14 is a perspective view showing the base 6*c* in a transparent mode. In the storage operation of the tray 7, a position of the tray 7 shifted to the L side in the X direction is pushed. In such a case, the side of the push operation of the tray 7 in the X direction is moved first, and a delay is generated in movement on the opposite side in the X direction. As in the example shown in FIG. 9B, the tray 7 is tilted until the regulating portion 61L abuts against the side surface 70L. If the tray 7 is tilted at the position where the tray 7 pulled out to the maximum is located, the engagement of one of a set of the engaging portions 72R and 62R and a set of the engaging portions 72L and 62L may be released and the other set may become the center of rotation of the tilt of the tray 7. In this case, the operation of the tray 7 may become heavy due to an increase in friction between the regulating portion 61R and the side surface 70R or an increase in friction between the slide contact portion 71R and the guide portion 60R.

However, in this embodiment, the stoppers 63R and 63L can avoid the state as described above. The stopper 63R is located on the outer side (R side) of the set of the engaging portions 62R and 72R in the X direction. Similarly, the stopper 63L is located on the outer side (L side) of the set of the engaging portions 62L and 72L in the X direction. In the example shown in FIG. 14, at first, the center of rotation of the tilt of the tray 7 is the engagement part between the engaging portion 72R and the corresponding engaging portion 62R. Due to the tilt of the tray 7, the L side in the X direction moves to the F side. Then, the slide contact portion 71R abuts against the stopper 63R, and its movement is regulated. As a result, the center of rotation of the tray 7 is transitioned to the abutting point between the slide contact portion 71R and the stopper 63R. Consequently, the position of the engaging portion 72R changes, so that the engagement between the engaging portion 72R and the engaging portion 62R is released. Thus, it is possible to avoid an increase in friction between the regulating portion 61L and the side surface 70L and an increase in friction between the slide contact portion 71L and the guide portion 60L.

OTHER EMBODIMENTS

The discharging trays 6 and 7 have been described in the above-described embodiment, but the structure thereof is also applicable to the trays 20 and 21 forming the feeding tray unit 2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-023661, filed Feb. 14, 2020, which is hereby incorporated by reference herein in its entirety.

What is claimed is:

1. A printing apparatus that performs printing on a sheet, comprising:

a tray on which the sheet is to be stacked;

a container configured to store the tray such that the tray can be pulled out;

a first guide unit configured to guide a slide of the tray from the container in a pull-out direction;

a second guide unit spaced apart from the first guide unit in a widthwise direction of the tray and configured to guide the slide of the tray from the container in the pull-out direction;

a first regulating portion provided in the container and configured to regulate, by abutting against the tray, a tilt of the tray to one direction in the widthwise direction; and a second regulating portion provided in the container and configured to regulate, by abutting against the tray, a tilt of the tray to the other direction in the widthwise direction.

2. The apparatus according to claim 1, wherein the first guide unit and the second guide unit are located between the first regulating portion and the second regulating portion in the widthwise direction.

3. The apparatus according to claim 1, wherein the first guide unit and the first regulating portion are arranged so as to be symmetric with the second guide unit and the second regulating portion with respect to a center of the tray in the widthwise direction.

4. The apparatus according to claim 3, wherein regardless of a position of the tray with respect to the container, slide contact portions of the first guide unit and the second guide unit are located at positions shifted from the first regulating portion and the second regulating portion, respectively, in the pull-out direction.

5. The apparatus according to claim 1, wherein each of the first guide unit and the second guide unit includes a guide portion provided on one of the tray and the container and extended in the pull-out direction, and a slide contact portion provided on the other one of the tray and the container and capable of abutting against the guide portion in the widthwise direction, the first regulating portion is arranged so as to abut against the tray before both the slide contact portions of the first guide unit and the second guide unit abut against the corresponding guide portions when the tray is tilted to the one direction, and the second regulating portion is arranged so as to abut against the tray before both the slide contact portions of the first guide unit and the second guide unit abut against the corresponding guide portions when the tray is tilted to the other direction.

6. The apparatus according to claim 5, wherein regardless of a position of the tray with respect to the container, the slide contact portions of the first guide unit and the second guide unit are located at positions shifted from the first regulating portion and the second regulating portion, respectively, in the pull-out direction.

7. The apparatus according to claim 1, wherein the first regulating portion is arranged so as to abut against one side surface of the tray in the widthwise direction, and the second regulating portion is arranged so as to abut against the other side surface of the tray in the widthwise direction.

8. The apparatus according to claim 1, wherein the first regulating portion and the second regulating portion are arranged in end portions of the container on a near side in the pull-out direction.

9. The apparatus according to claim 1, further comprising:

a first engaging portion provided on the container; and a second engaging portion provided on the tray and configured to engage with the first engaging portion at a pulled-out position where the tray pulled out from the container is located.

10. The apparatus according to claim 9, further comprising a stopper provided on the tray and configured to regulate that the tray is pulled out beyond the pulled-out position.

11. The apparatus according to claim 1, wherein the tray includes a pair of side surfaces extended in the pull-out direction, the first guide unit and the first regulating portion are arranged so as to be symmetric with the second guide unit and the second regulating portion with respect to a center of the tray in the widthwise direction, each of the first guide unit and the second guide unit includes a guide portion provided on the container and extended in the pull-out direction, and a slide contact portion provided on the tray and capable of abutting against the guide portion in the widthwise direction, the first regulating portion is arranged so as to abut against one side surface of the pair of side surfaces in the widthwise direction, the second regulating portion is arranged so as to abut against the other side surface of the pair of side surfaces in the widthwise direction, and regardless of a position of the tray with respect to the container in the pull-out direction, the slide contact portions of the first guide unit and the second guide unit are located on a far side in the pull-out direction with respect to the first regulating portion and the second regulating portion.

12. The apparatus according to claim 11, further comprising:

a first engaging portion provided on the container;

a second engaging portion provided on the tray and configured to engage with the first engaging portion at a pulled-out position where the tray pulled out from the container is located;

a first stopper provided on the tray and configured to regulate that the tray is pulled out beyond the pulled-out position; and a second stopper provided on the tray and configured to regulate that the tray is pulled out beyond the pulled-out position, wherein by abutting against the slide contact portion of the first guide unit, the first stopper regulates that the tray is pulled out beyond the pulled-out position, and by abutting against the contact slide portion of the second guide unit, the second stopper regulates that the tray is pulled out beyond the pulled-out position.

13. The apparatus according to claim 1, wherein the tray is a discharging tray onto which a printed sheet is discharged.

14. The apparatus according to claim 1, wherein the tray is a feeding tray on which an unprinted sheet is stacked.

15. A tray unit, on which trays are placed, comprising:

a first tray on which a sheet is to be stacked;

a second tray configured to store the first tray such that the first tray can be pulled out;

a first guide unit configured to guide a slide of the first tray from the second tray in a pull-out direction;

a second guide unit spaced apart from the first guide unit in a widthwise direction of the first tray and configured to guide the slide of the first tray from the second tray in the pull-out direction;

a first regulating portion provided in the second tray and configured to regulate, by abutting against the first tray, a tilt of the first tray to one direction in the widthwise direction; and a second regulating portion provided in the second tray and configured to regulate, by abutting against the first tray, a tilt of the first tray to the other direction in the widthwise direction.

* * * * *